US007650862B2

(12) United States Patent
Matsuda

(10) Patent No.: US 7,650,862 B2
(45) Date of Patent: Jan. 26, 2010

(54) ENGINE AND MOTORCYCLE

(75) Inventor: Yoshimoto Matsuda, Kobe (JP)

(73) Assignee: Kawasaki Jukogyo Kabushiki Kaisha, Kobe-shi, Hyogo (JP)

( * ) Notice: Subject to any disclaimer, the term of this patent is extended or adjusted under 35 U.S.C. 154(b) by 62 days.

(21) Appl. No.: 11/975,132

(22) Filed: Oct. 16, 2007

(65) Prior Publication Data

US 2008/0087246 A1 Apr. 17, 2008

(30) Foreign Application Priority Data

Oct. 17, 2006 (JP) ..... 2006-283006

(51) Int. Cl.
*F01L 35/00* (2006.01)

(52) U.S. Cl. ..... 123/90.27

(58) Field of Classification Search ..... 123/90.27, 123/196 R, 196 M, 193.5, 193.3
See application file for complete search history.

(56) References Cited

U.S. PATENT DOCUMENTS 4,343,270 A * 8/1982 Kawabe ..... 123/196 V
4,610,224 A * 9/1986 Fujita ..... 123/90.31
4,674,452 A * 6/1987 Asanomi ..... 123/90.31
4,957,079 A * 9/1990 Nakatani et al. ..... 123/90.34
4,991,549 A * 2/1991 Sugiura ..... 123/90.27
5,052,351 A * 10/1991 Nishimura et al. ..... 123/90.27
5,111,791 A * 5/1992 Onodera ..... 123/432
5,178,108 A * 1/1993 Beaber ..... 123/90.31
5,181,485 A * 1/1993 Hirose et al. ..... 123/90.17
RE35,382 E * 11/1996 Saito ..... 123/90.27
6,568,253 B1 * 5/2003 Kubo et al. ..... 73/114.63
6,763,792 B2 * 7/2004 Okamoto ..... 123/90.31
7,455,039 B2 * 11/2008 Nakayama ..... 123/90.31
2003/0094150 A1 * 5/2003 Romblom et al. ..... 123/90.17

FOREIGN PATENT DOCUMENTS

JP 60-243307 12/1985

* cited by examiner

*Primary Examiner*—M. McMahon
(74) *Attorney, Agent, or Firm*—Alleman Hall McCoy Russell & Tuttle LLP

(57) ABSTRACT

A multiple-cylinder DOHC engine, including a cylinder head, a first camshaft that is mounted on the cylinder head and is configured to drive one of an intake valve and an exhaust valve mounted on the cylinder head, a second camshaft that is mounted on the cylinder head and is configured to drive the other one of an intake valve and an exhaust valve, a camshaft drive system that is mounted at an end portion of the first camshaft in an axial direction thereof and is configured to drive the first camshaft, and a driving power transmission mechanism that is disposed at a center portion of the first and second camshafts in the axial direction to transmit a driving power from the first camshaft to the second camshaft.

9 Claims, 12 Drawing Sheets

F

ENGINE AND MOTORCYCLE

TECHNICAL FIELD

The present invention relates to an overhead cam engine and a motorcycle equipped with the engine.

BACKGROUND

A center cam train structure for driving a camshaft which is used in, for example, an inline four-cylinder overhead cam engine or the like for a motorcycle, is disclosed in Japanese Laid-Open Patent Application Publication No. Sho. 60-243307. FIG. 1A is a plan view of a cylinder head 5A having a conventional center cam train structure. The center cam train structure is configured in such a manner that a chain line unit 4 disposed at a center of four cylinders 1 (indicated by broken-line circles in FIG. 1A) aligned in the width direction of cylinder head 5A drives two camshafts 2 that are provided with cams 3 and are respectively configured to drive an intake valve and an exhaust valve.

It is necessary to fasten cylinder head 5A to a cylinder block (not shown) located thereunder firmly by bolts 6 at opposite sides of each cylinder 1, in order to withstand the stress generated during combustion in each cylinder 1.

In the above-described center cam train structure, however, the chain line unit 4 provided with a sprocket 4*a* is disposed at the center, and the bolts 6 cannot be disposed at a region of the cylinder head 5A that is protruded to conform in shape to the sprocket 4*a*. For this reason, the bolts 6 are forced to be disposed at opposite sides with respect to the sprocket 4*a* in the width direction of the cylinder head 5A, and the width of the entire cylinder head 5A may increase by a distance B between the bolts 6 disposed at opposite sides of the sprocket 4*a* in the width direction of the cylinder head 5A. The width of the entire cylinder head 5A is equal to a length indicated by "4A+B" in FIG. 1A.

To solve the above described problem, a side cam train structure has been commonly used. FIG. 1B is a plan view of a cylinder head having a conventional side cam train structure. In the side cam train structure, the chain line unit 4 is positioned at an end portion of cylinder head 5B. Advantageously, the side cam train structure allows the width of cylinder head 5B to be substantially smaller than that of cylinder head 5A by a length "B'," that is typically 20 to 30 mm, approximately.

The reduction of the width of the cylinder head is favorable for a motorcycle having a frame structure such as a double cradle frame structure, in which a main frame has a pair of tank rail frame members.

The pair of tank rail frame members has a large rectangular cross-sectional area. Spaced apart from each other, the pair of tank rail frame members extends rearward and downward from a head pipe. A fuel tank is disposed to extend along and above the tank rail frame members. The cylinder head is typically disposed between the pair of tank rail frame members. If the distance between the pair of tank rail frame members increases, then stiffness, in particular longitudinal stiffness and torsional stiffness of the entire frame of the motorcycle increases, but toughness of the entire frame decreases, making it difficult for a rider to turn and steer the motorcycle.

SUMMARY OF THE INVENTION

The present invention addresses the above-described conditions. An object of the present invention is to provide an overhead cam engine having a compact cylinder head and a motorcycle that is equipped with the engine, thereby avoiding an increase in the width of the frame of the motorcycle.

According to a first aspect of the present invention, there is provided a multiple-cylinder DOHC (double overhead cam) engine, comprising a cylinder head, a first camshaft that is mounted on the cylinder head and is configured to drive one of an intake valve and an exhaust valve mounted on the cylinder head, a second camshaft that is mounted on the cylinder head and is configured to drive the other one of the intake valve and the exhaust valve, a camshaft drive system that is mounted at an end portion of the first camshaft in an axial direction thereof and is configured to drive the first camshaft, and a driving power transmission mechanism that is disposed at a center portion of the first and second camshafts in the axial direction to transmit a driving power from the first camshaft to the second camshaft.

In accordance with this configuration, since the camshaft drive system is positioned at the end portion of the camshaft, a width of the cylinder head can be set substantially the same as that having a side cam train structure. In addition, since the camshaft drive system is configured to drive only the first camshaft, a space in the cylinder head for accommodating the camshaft drive system can be formed to occupy substantially half of the space accommodating the camshaft drive system in the side cam train structure which drives the first and second camshafts.

The cylinder head may be fastened to the cylinder block located thereunder by a bolt in a location below the driving power transmission mechanism. In such a configuration, since it is not necessary to provide bolt mounting positions outside the driving power transmission mechanism, the size of the cylinder head, particularly in a forward and rearward direction, and its weight, can be reduced.

At least one of the driving power transmission mechanism and the camshaft drive system may have a valve timing adjusting mechanism. In such a configuration, the valve timing adjusting mechanism can be easily disposed.

The engine may further comprise first lubricating oil passages that are formed at opposite end portions in the width direction of the cylinder head and are configured to feed lubricating oil sent from the cylinder block located thereunder to a cylinder head cover provided over the cylinder head, and second lubricating oil passages that are formed inside the cylinder head cover and are each configured to feed lubricating oil fed from the first lubricating oil passages to bearings of the camshafts. In such a configuration, the lubricating oil can be fed to the bearings of the camshafts from opposite sides in the width direction of the cylinder head without interfering with the driving power transmission mechanism disposed at the center portion of the camshafts.

The first camshaft may have an end portion extended to be longer than the end portion of the second camshaft in the width direction of the cylinder head, and the cylinder head may have a protruding portion for accommodating the end portion of the first camshaft and the camshaft drive system.

According to another aspect of the present invention, there is provided a motorcycle comprising a multiple-cylinder DOHC engine, including a cylinder head, a first camshaft that is mounted on the cylinder head and is configured to drive one of an intake valve and an exhaust valve mounted on the cylinder head, a second camshaft that is mounted on the cylinder head and is configured to drive the other one of the intake valve and the exhaust valve, a camshaft drive system that is mounted at an end portion of the first camshaft in an axial direction thereof and is configured to drive the first camshaft, and a driving power transmission mechanism that is disposed at a center portion of the first and second camshafts in the axial direction to transmit driving power from the first camshaft to the second camshaft.

In a state where the engine is mounted in the motorcycle, the second camshaft may be positioned forward relative to the first camshaft. In such a configuration, since the camshaft that is not attached with the camshaft drive system is positioned forward, i.e., in a space between the pair of tank rail frame members, the distance between the pair of tank rail frame members can be reduced.

The above and further objects and features of the invention will more fully be apparent from the following detailed description with accompanying drawings.

DETAILED DESCRIPTION OF THE PREFERRED EMBODIMENTS

Hereinafter, an engine according to an embodiment of the present invention, and a motorcycle equipped with the engine will be described with reference to the accompanying drawings.

Figure 1A:
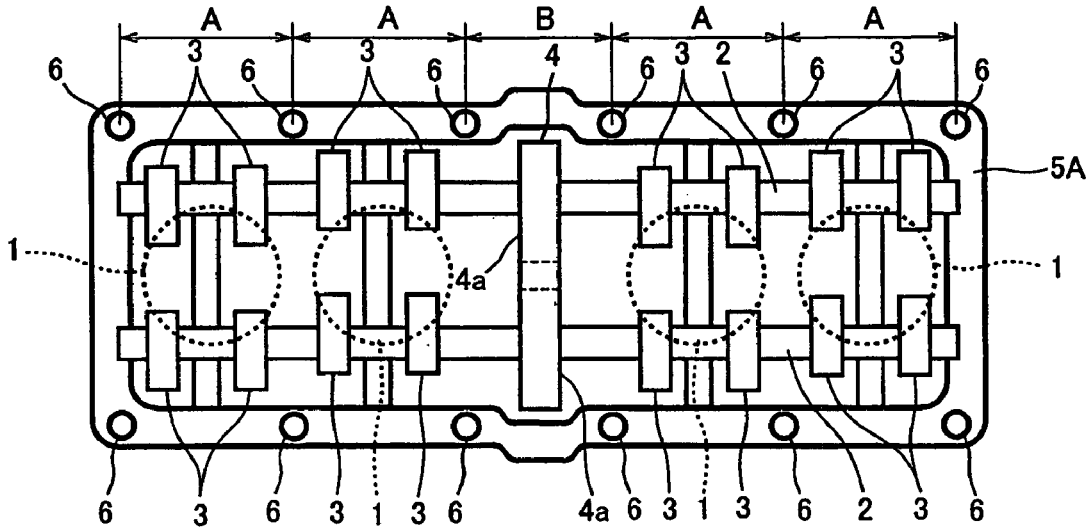
Fig. 1A (PRIOR ART)
FIG. 1A is a plan view of a cylinder head having a conventional center cam train structure.
Figure 1B:
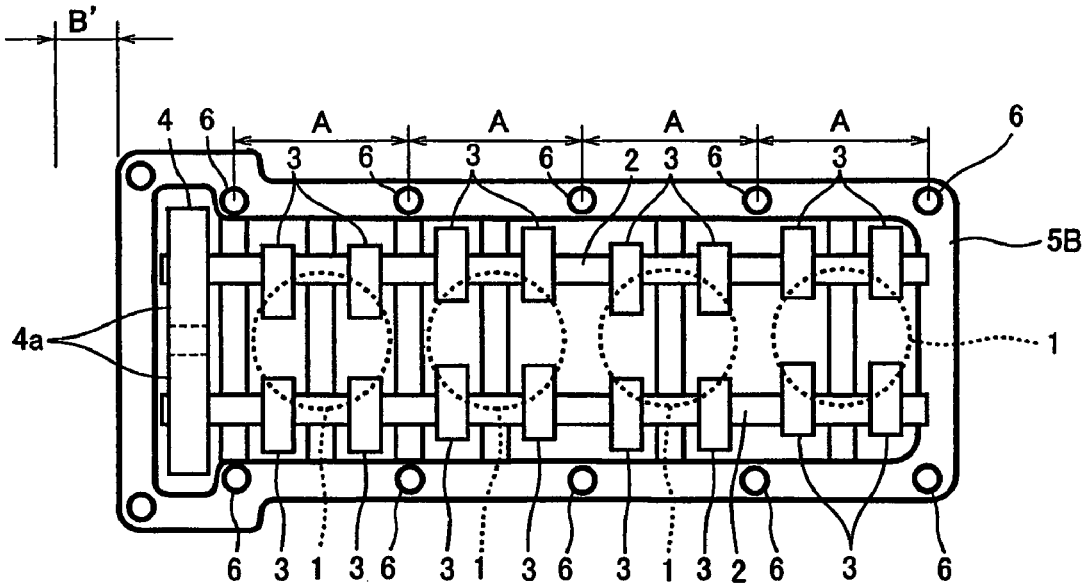
Fig. 1B (PRIOR ART)
FIG. 1B is a plan view of a cylinder head having a conventional side cam train structure.
Figure 2:
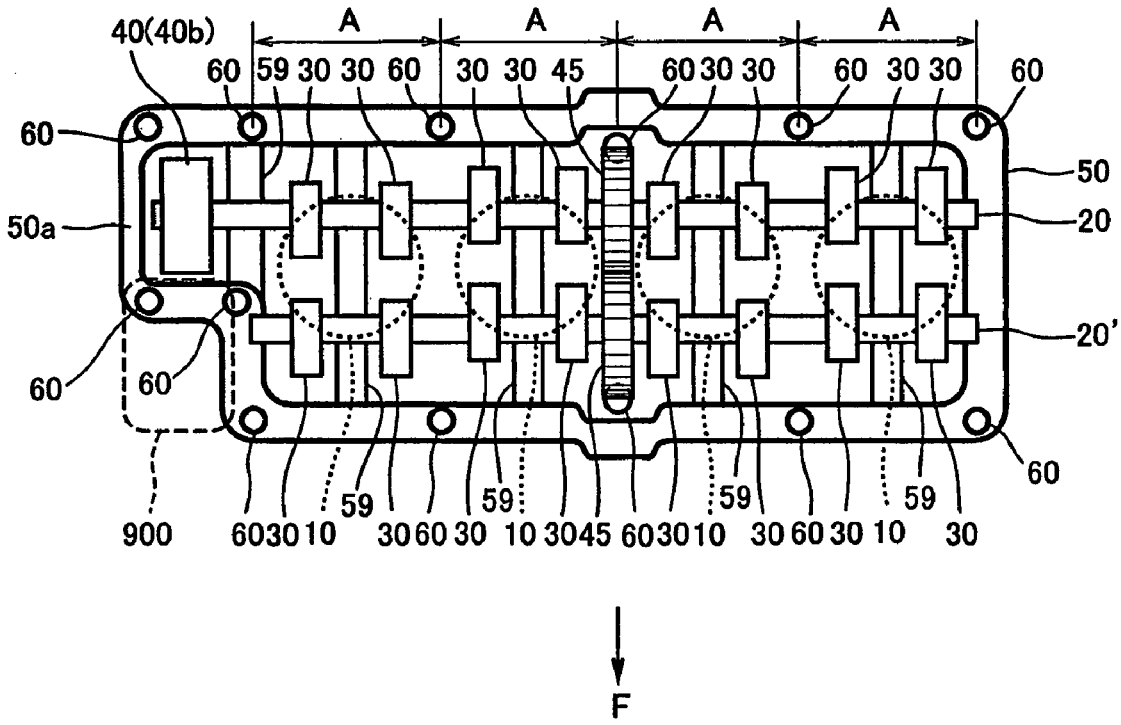
FIG. 2 is a plan view of a cylinder head of an engine according to an embodiment of the present invention, in which a first camshaft is positioned rearward in the cylinder head.

FIG. 2 is a plan view of a cylinder head 50 of the engine according to an embodiment of the present invention. As shown in FIG. 2, the cylinder head 50 of the engine is applied to an in-line four-cylinder DOHC (double overhead camshaft) engine but may be suitably applied to other multi-cylinder DOHC engines.

In the embodiment, "F" indicates a forward direction of the motorcycle 100 (see FIG. 3) of the embodiment.

The cylinder head 50 is provided with a first camshaft 20 and a second camshaft 20' disposed to extend along a direction in which cylinders 10 are aligned, i.e., in the width direction of the cylinder head 50. Each of the first and second camshafts 20 and 20' has cams 30 for each cylinder 10. The cams 30 of one of the first and second camshafts 20 and 20' drives an intake valve (not shown), and the cams 30 of the other one of the camshafts 20 and 20' drives an exhaust valve (not shown).

The first camshaft 20 is extended to be longer than the second camshaft 20' in the width direction of the cylinder head 50. One end portion of the first camshaft 20 protrudes farther than the end portion of the second camshaft 20'. The cylinder head 50 has a protruding portion 50*a* for accommodating the one end portion of the first camshaft 20 and a camshaft drive system 40 mounted at the one end portion of the first camshaft 20. The camshaft drive system 40 is capable of driving the first camshaft 20. The camshaft drive system 40 may be a chain and sprocket mechanism, a belt and pulley mechanism, or a gear mechanism.

The camshaft drive system 40 is typically coupled to a crankshaft (not shown) and is configured to drive the first camshaft 20 at a rotational speed that is substantially half of the rotational speed of the crankshaft.

At a center position of the two camshafts 20 and 20' in the width direction of the cylinder head 50, i.e., a center position between the cylinders 10, gears 45 are mounted to mesh with each other. The gears 45 form a driving power transmission mechanism to transmit a driving power from the first camshaft 20 to the second camshaft 20'. The illustrated gear mechanism is merely exemplary: a chain and sprocket mechanism or a belt and pulley mechanism may be used instead as the driving power transmission mechanism.

The driving power transmission mechanism mounted within the cylinder head 50 allows bolts 60 by which the cylinder head 50 is fastened to a cylinder block 51 located thereunder (see FIG. 4A) to be disposed in a space below the gear 45. That is, the width of the cylinder head 50 can be substantially equal to that of a cylinder head having a side cam train structure. In FIG. 2, A indicates a pitch between the bolts 50.

Since the camshaft drive system 40 of this embodiment is configured to directly drive only the first camshaft 20, the cylinder head 50 is smaller than that of a conventional side cam train structure by a space 900 that is adjacent the protruding portion 50*a* and corresponds to a part of the second camshaft 20'.

The reduction of the size of the cylinder head 50 makes a cylinder head cover (simply referred to as a head cover) provided thereover smaller. Compared to a conventional side cam train, the engine including the cylinder head 50 has a lower center of gravity and a lighter weight.

Figure 3:
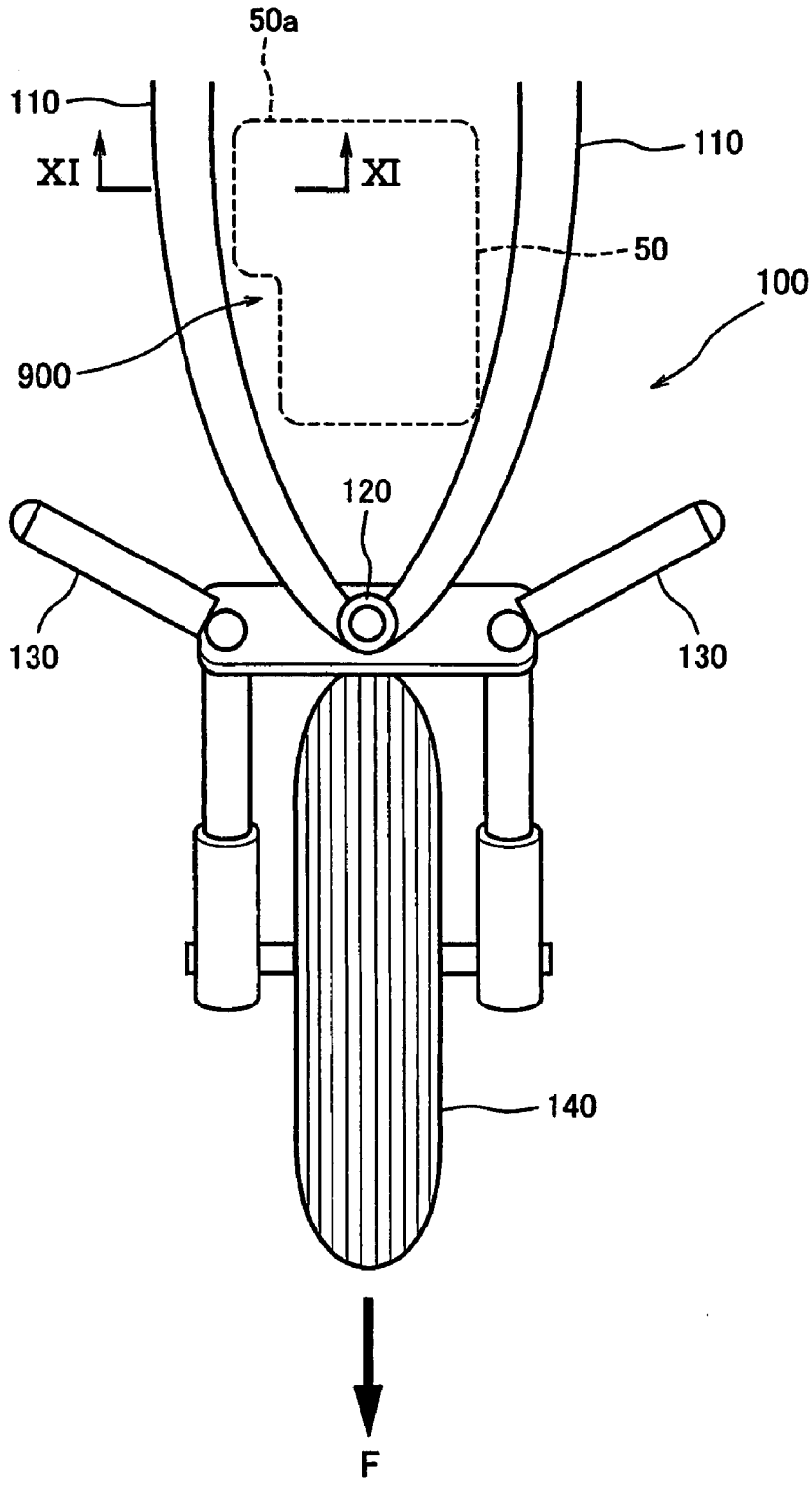
FIG. 3 is a partial plan view of a motorcycle, showing an example of placement of the cylinder head of the engine of FIG. 2.

FIG. 3 shows an example in which the cylinder head 50 of this embodiment is applied to a motorcycle 100. As shown in FIG. 3, the motorcycle 100 has a double cradle frame structure in which a main frame has a pair of tank rail frame members 110.

In the double cradle frame structure, the pair of tank rail frame members 110 typically have rectangular cross-sections extending rearward and downward from a head pipe 120 so as to be spaced apart from each other, and a fuel tank (not shown) and the like are disposed thereabove to extend along the frame members 110. In the example illustrated in FIG. 3, the cylinder head 50 is disposed in such a manner that the space 900 is directed forward. In other words, the first camshaft 20 to be driven by the camshaft drive system 40 is positioned rearward.

The pair of tank rail frame members 110 are coupled at front end portions thereof to the head pipe 120 and have a width that is smaller in the vicinity of the front end portions of the frame members 110. Since the cylinder head 50 is disposed in such a manner that the space 900 is directed forward, the distance between the pair of tank rail frame members 110 can be made smaller.

By reducing the distance as described above, a handle bar 130 for steering a front wheel 140 is less likely to interfere with the tank rail frame members 110, positions of knee grips of the rider are optimized, and stiffness of the entire frame is well-balanced. In particular, longitudinal stiffness and torsional stiffness are reduced. As a result, the rider is able to turn and steer the motorcycle 100 more easily.

Figure 4A:
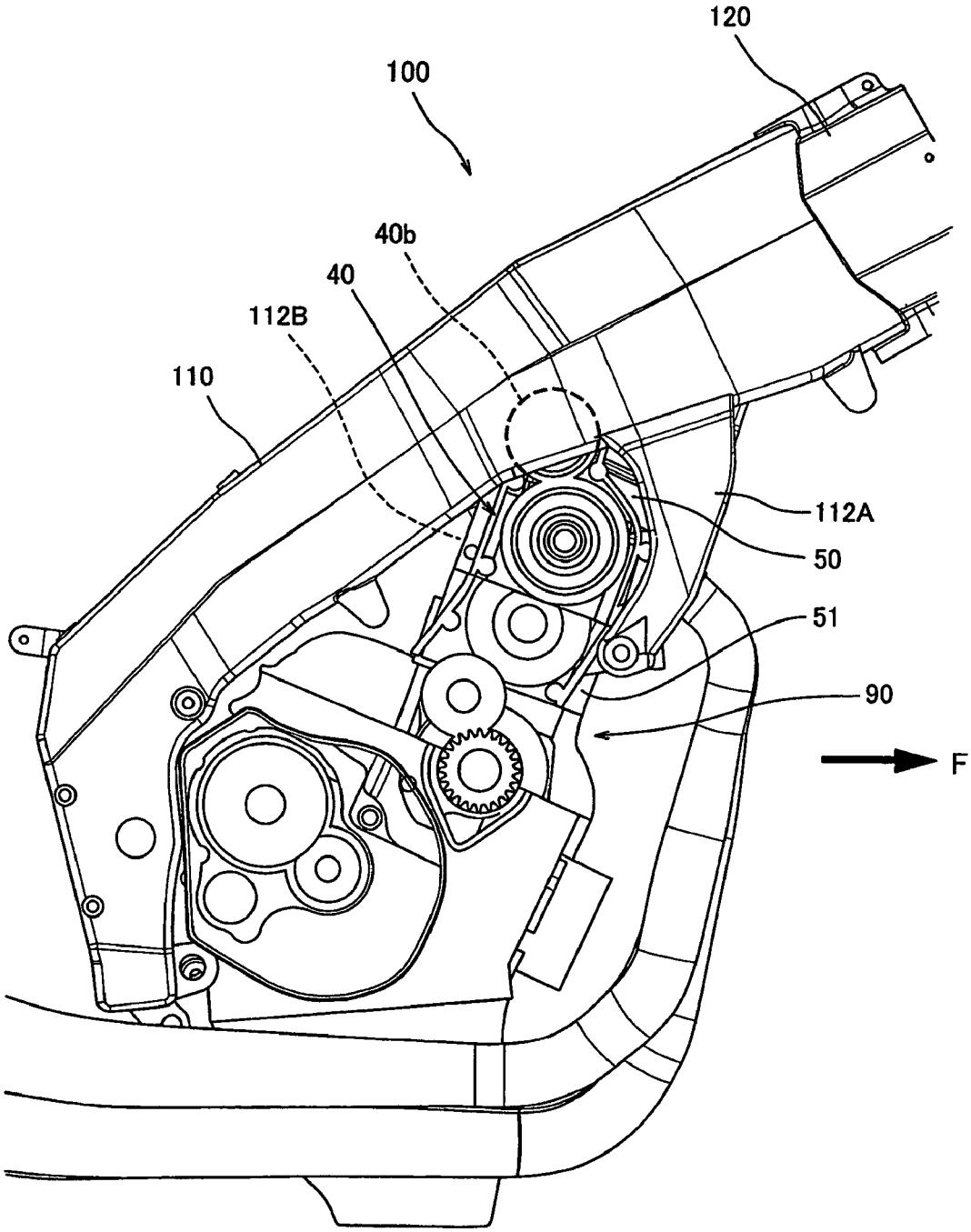
FIG. 4A is a partial cross-sectional right-side view of the motorcycle, showing an example of placement of the cylinder head of FIGS. 2 and 3.

FIG. 4A is a partial cross-sectional right-side view of the motorcycle 100. As described above, the camshaft drive system 40 is positioned rearward. The camshaft drive system 40 shown in FIG. 4A is constituted by a gear-drive mechanism. As shown in FIG. 4A, an engine 90 is suspended from a hanger frame 112A extending downward from the tank rail frame members 110 and is supported by the tank rail frame members 110 as the main frame via the hanger frame 112A. The hanger frame 112A of FIG. 4A extends downward in front of the engine 90 and is fastened to a front portion of the cylinder block 51. A driven gear 40*b* of the camshaft drive system 40 is coupled to the first camshaft 20 (see FIG. 2) provided rearward in the cylinder head 50 and is positioned between the pair of tank rail frame members 110. For this reason, even when the hanger frame 112A is positioned in a region corresponding to the space 900 in front of the driven gear 40*b*, the engine 90 and the hanger frame 112A do not interfere with each other. Therefore, the hanger frame 112 does not protrude forward, and the frame structure in forward and rearward directions becomes compact. This is very advantageous to the motorcycle 100 equipped with the engine 90 shown in FIG. 4A, in which the cylinders are disposed to be tilted forward.

Figure 4B:
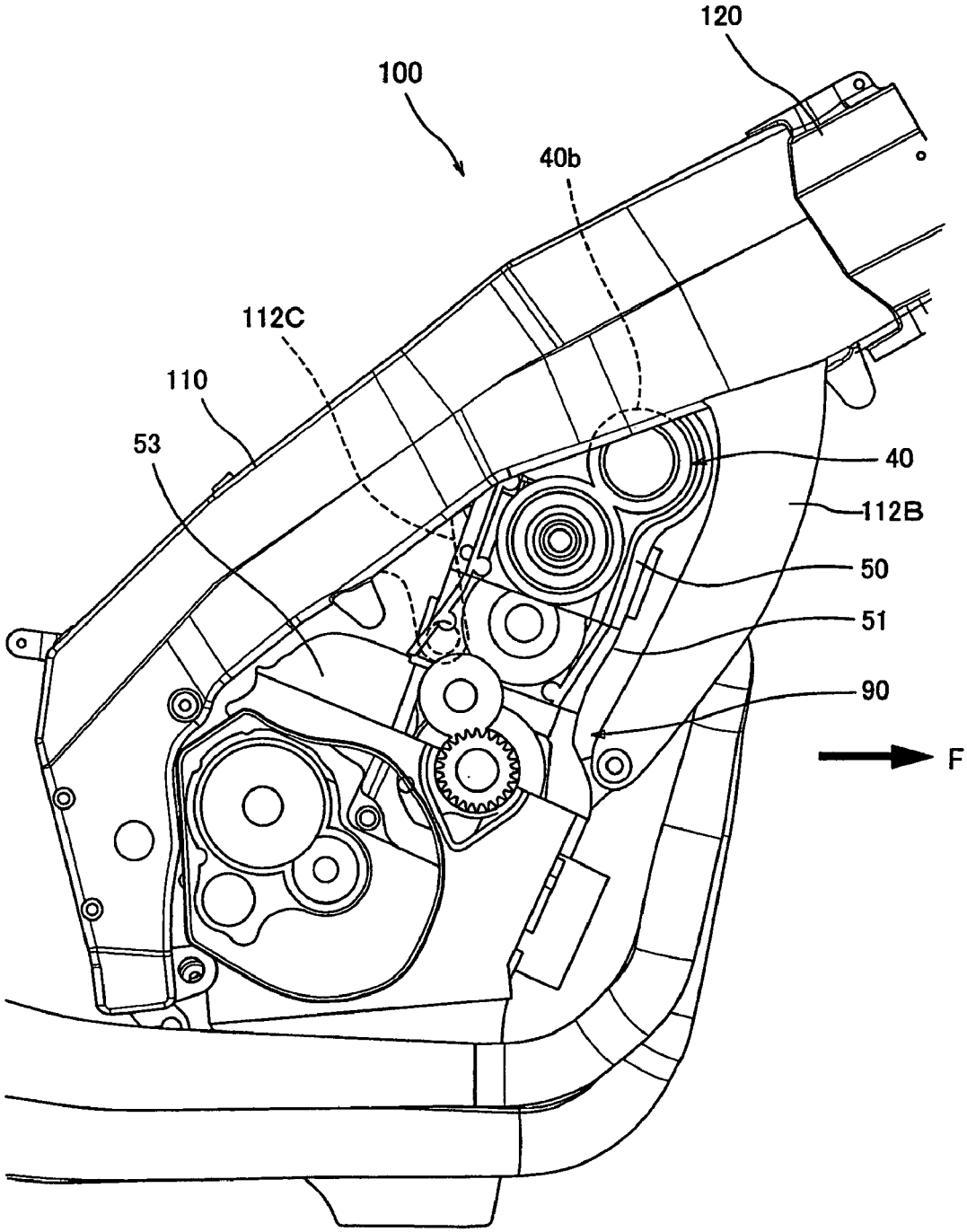
FIG. 4B is a partial cross-sectional right-side view of the motorcycle, showing an example of placement of another cylinder head of the engine, in which the first camshaft is positioned forward in the cylinder head.

FIG. 4B is a partial cross-sectional right-side view of the motorcycle 100, showing another example in which the camshaft drive system 40 is positioned forward in the cylinder head 50. When the camshaft drive system 40 is positioned forward, the driven gear 40*b* of the camshaft drive system 40 may interfere with the hanger frame 112A. To avoid such a circumstance, a hanger frame 112B is positioned slightly forward of a mounting position of the hanger frame 11A shown in FIG. 4A. In the structure shown in FIG. 4B, the hanger frame 112B is fastened to a front portion of a crankcase 53 fastened to a lower part of the cylinder block 51. More preferably, as shown by a broken line in FIG. 4B, instead of the hanger frame 112B, a hanger frame 112C is provided to extend downward behind the engine 90 and is fastened to a rear portion of the cylinder block 51. In this case, the hanger frame 112C is positioned in a dead space formed behind the cylinder block 51 and above the crankcase 53 in a substantially L-shaped in-line multi-cylinder engine. In this structure, interference between the engine 90 and the hanger frame 112B can be avoided, and the frame structure becomes compact as compared to the structure in which the hanger frame 112B is mounted.

As described above, since the cylinder head 50 can be positioned between the pair of tank rail frame members 110 without increasing the distance between the pair of tank rail frame members 110, the fuel tank, an ECU (electronic control unit), an air box, and the like are arranged above the tank rail frame members 110 at a relatively low position. This makes it possible to lower the center of gravity of the motorcycle. Since the fuel tank is disposed at a lower position, the rider can easily lower his or her upper body or face over the fuel tank, thereby improving running performance.

Figure 5:
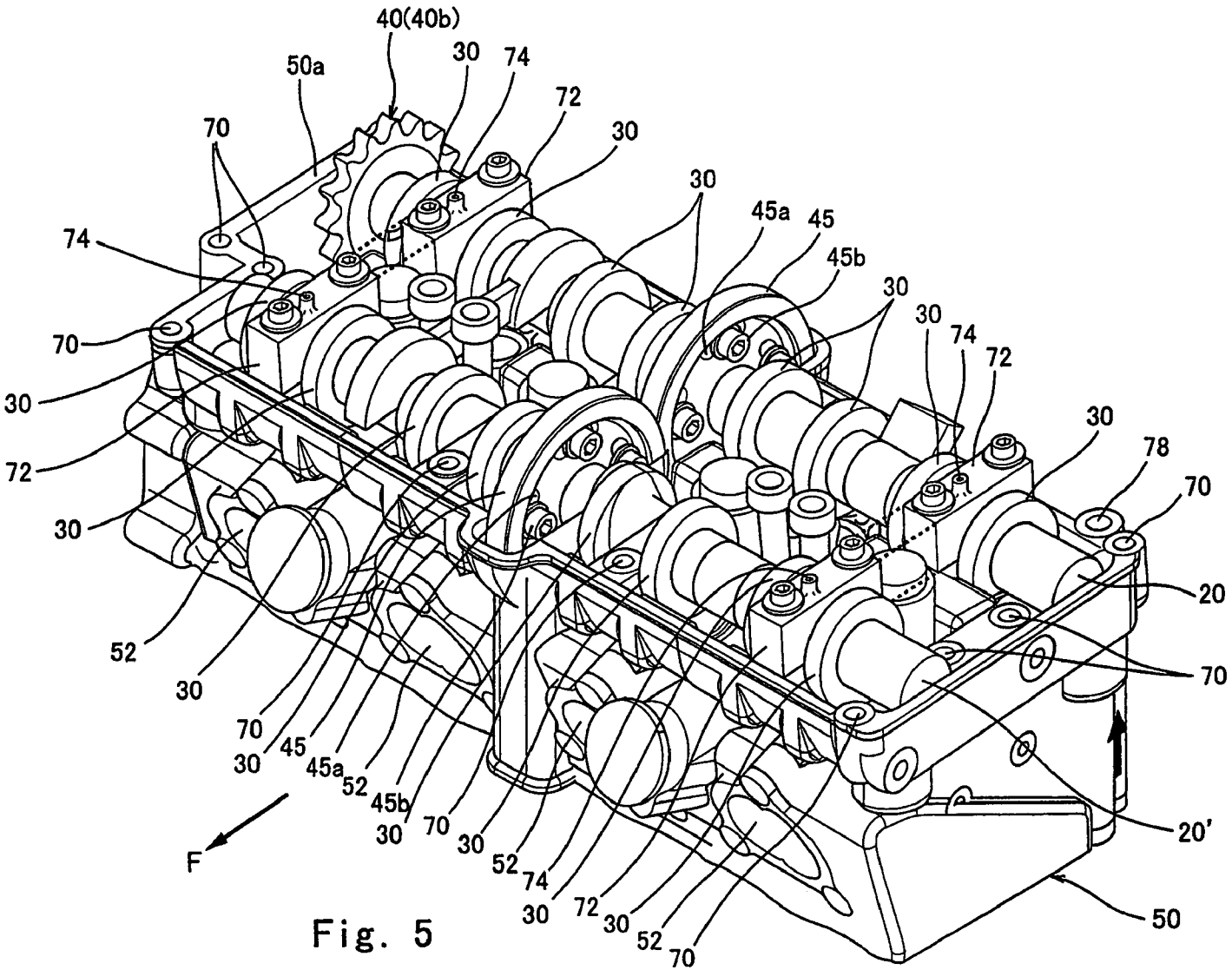
FIG. 5 is a perspective view of an internal structure of the cylinder head of FIG. 2.

FIG. 5 is a perspective view showing a detailed internal structure of the cylinder head 50 shown in FIG. 2. The two camshafts 20 and 20' are supported at their lower half parts on an upper surface of the cylinder head 50 via supporting members 59 (FIG. 2) formed integrally therewith such that the two camshafts 20 extend in a parallel direction and are rotatable around their axes. As shown in FIG. 2, the supporting members 59 are each positioned to correspond to each of the cylinders 10 and between a pair of cams 30.

As described later, a head cover 80 (see FIGS. 6 and 11) has a supporting member 89 (FIG. 11) in a position corresponding to the support member 59 (FIG. 2) of the cylinder head 50 (except positions where camshaft caps 72 described later support the camshafts 20 and 20'). The supporting member 89 (FIG. 11) retains camshafts 20 and 20' from above with the supporting members 59 such that the camshafts 20 and 20' are rotatable around their axes.

Each of the first and second camshafts 20 and 20' has eight cams 30 mounted at equal intervals in an axial direction thereof. The cams 30 have cam surfaces to actuate the valves (not shown). In this embodiment, two intake valves and two exhaust valves are provided for each of the cylinders.

The gears 45 are mounted at a center position of the first and second camshafts 20 in the width direction of the cylinder head 50 and are in mesh with each other. Thereby, the camshaft drive system 40 drives the first camshaft 20 (on the intake valve side in this embodiment) and driving power is transmitted to the second camshaft 20' (on the exhaust valve side in the embodiment) via a gear 45, causing the cams 30 of the second camshaft 20' to be activated. In FIG. 5, reference numeral 52 denotes exhaust ports.

Each of the first and second camshafts 20 and 20' is rotatably fastened to the upper surface of the cylinder head 50 at opposite end portions from above. In this embodiment, each of the camshaft caps 72 is disposed to press the camshafts 20 and 20' between the cams 30 located at both end portions of the camshafts 20 and 20'.

Whereas in the structure shown in FIG. 5, the camshaft caps 72 are separately disposed for the first and second camshafts 20 and 20', one elongated camshaft cap may alternatively press these camshafts 20 and 20', as indicated by a broken line in FIG. 5.

In this embodiment, each of the gears 45 is provided with a valve timing adjusting mechanism. The valve timing adjusting mechanism is a known mechanism that serves to adjust a rotational phase of the gear 45 with respect to the camshafts 20 and 20' by adjusting a position of a bolt 45*b* within an elongated hole 45*a* formed in the gear 45 to extend in a circumferential direction of the gear 45.

The camshaft caps 72 enable the camshafts 20 and 20' to be fastened to the cylinder head 50 before the head cover 80 (see FIG. 6) is placed over the cylinder head 50. In addition, in this state, the camshaft caps 72 enable valve timing adjusting mechanisms formed at the gear 45 to adjust the valve timings.

Furthermore, a clearance between the cam surface and a tappet, namely a tappet clearance can be adjusted before the head cover 80 (see FIG. 6) is placed over the cylinder head 50.

Figure 6:
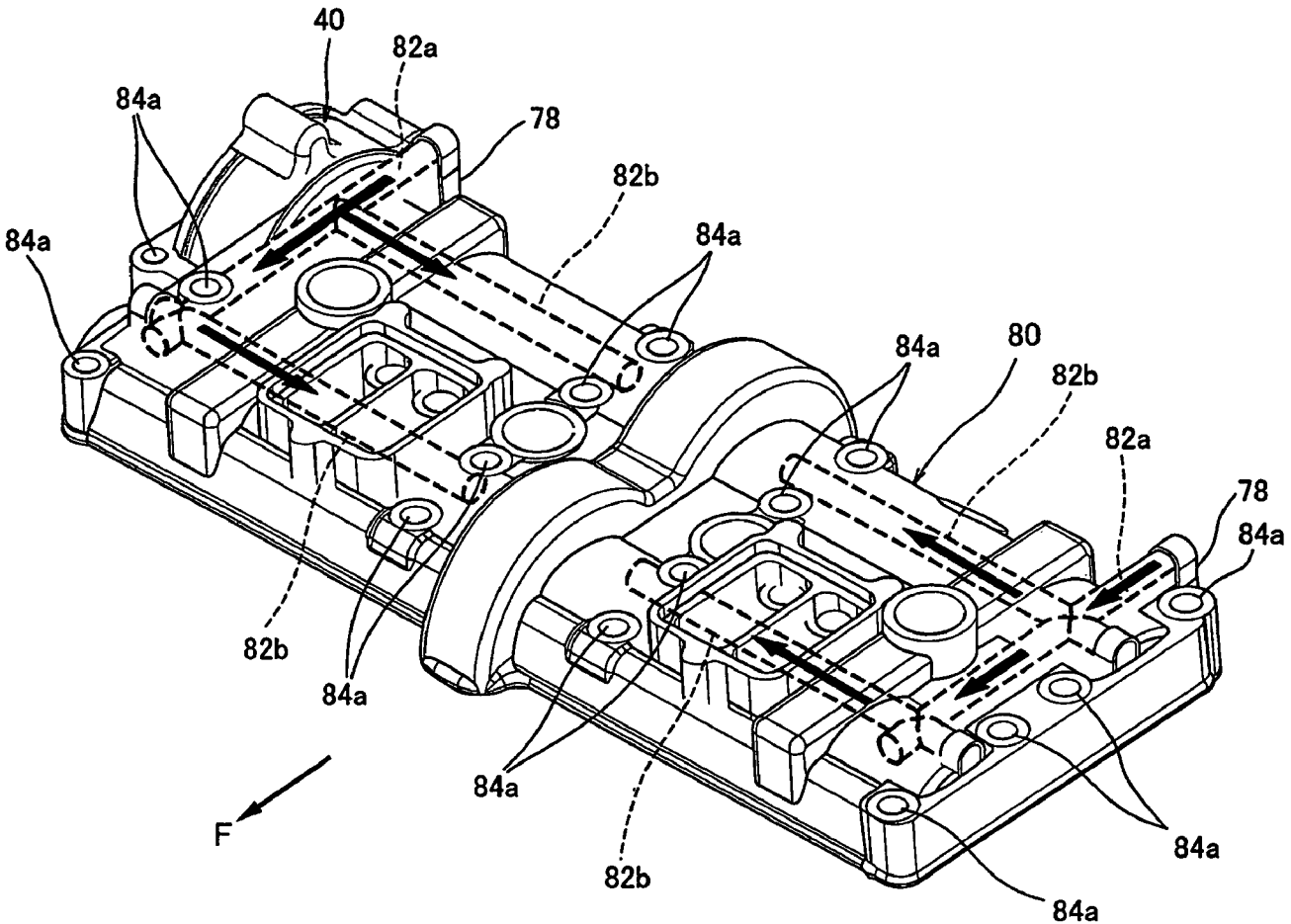
FIG. 6 is a perspective view showing a cylinder head cover for the cylinder head of FIG. 5.
Figure 11:
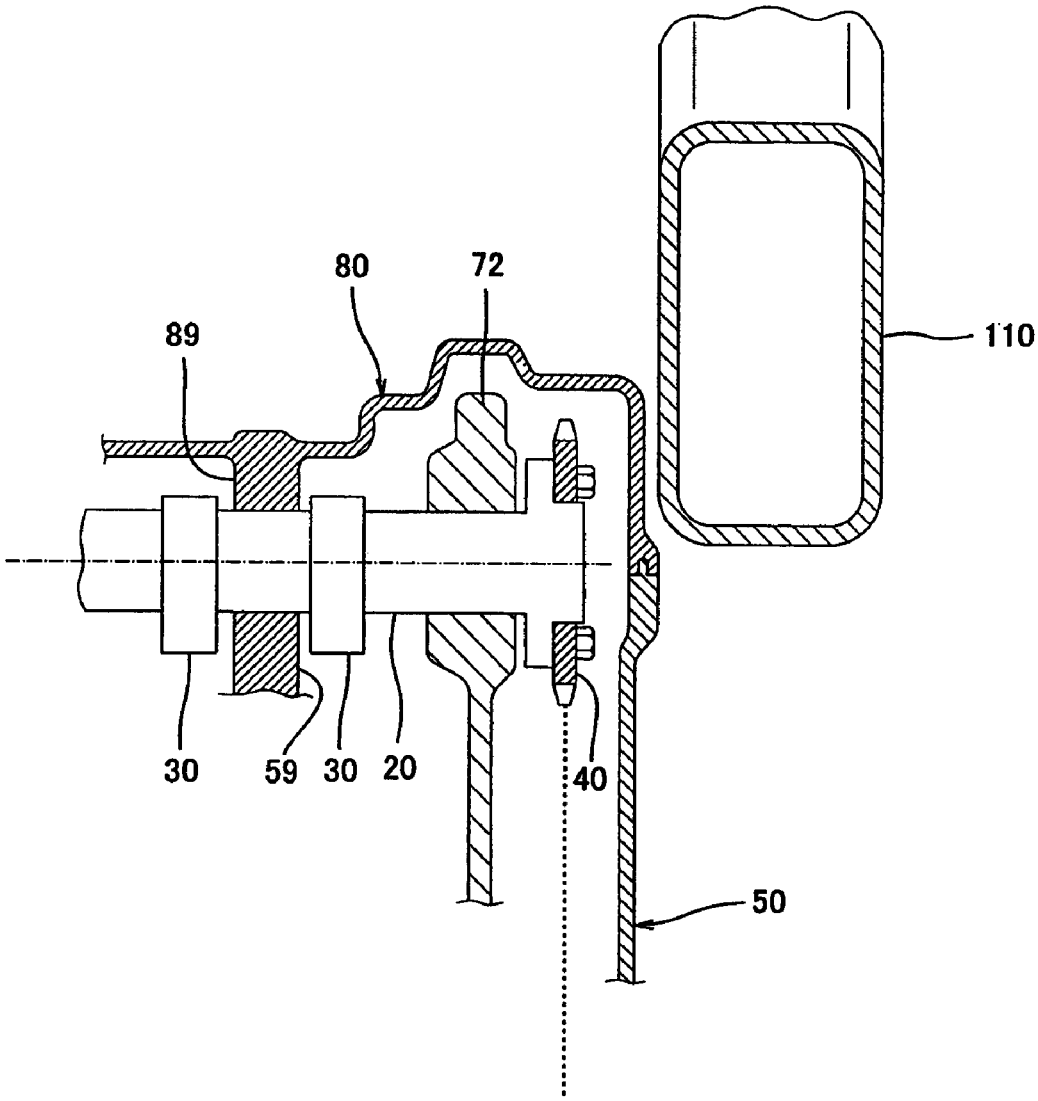
FIG. 11 is a cross-sectional view taken substantially along line XI-XI of FIG. 3.

As shown in FIGS. 6 and 11, the head cover 80 is formed to press a portion of the camshafts 20 and 20' that is not pressed by the camshaft cap 52 (see FIG. 5).

As described above, the head cover 80 has the plurality of supporting members 89 to retain from above the portion of the camshaft 20 and 20' that is not pressed by the camshaft caps 72 in the position corresponding to the supporting members 59 (FIG. 2) of the cylinder head 50 such that the camshafts 20 and 20' are rotatable around their axes. The supporting members 89 and the supporting members 59 form bearings. In FIG. 11, along with the camshaft drive system 40, the chain and sprocket mechanism is illustrated.

The head cover 80 is provided over the upper surface of the cylinder head 50 so as to cover the camshafts 20 and 20', the gears 45, the camshaft drive system 40, the camshaft caps 72, and other components. As shown in FIG. 6, the head cover 80 is provided with a number of through holes 84*a*. Bolts 84 (see an assembly in FIG. 7) are inserted into the through holes 84*a* and are threaded into threaded holes 70 (FIG. 5) formed on the upper surface of the cylinder head 50 to correspond to the through holes 84*a*, thus fastening the head cover 80 onto the cylinder head 50.

As shown in FIG. 5, in this embodiment, the threaded holes 70 are positioned on the upper surface of the cylinder head 50 between the pair of cams 30 and at opposite end portions in the width direction of the cylinder head 50. Since the camshaft caps 72 press the camshafts 20 and 20' inside the head cover 80 (FIG. 11), the through holes 84*a* formed at the end portions in the width direction of the cylinder head 50 (and the threaded holes 70 of the cylinder head 50) may be reduced in number or otherwise omitted.

Figure 7:
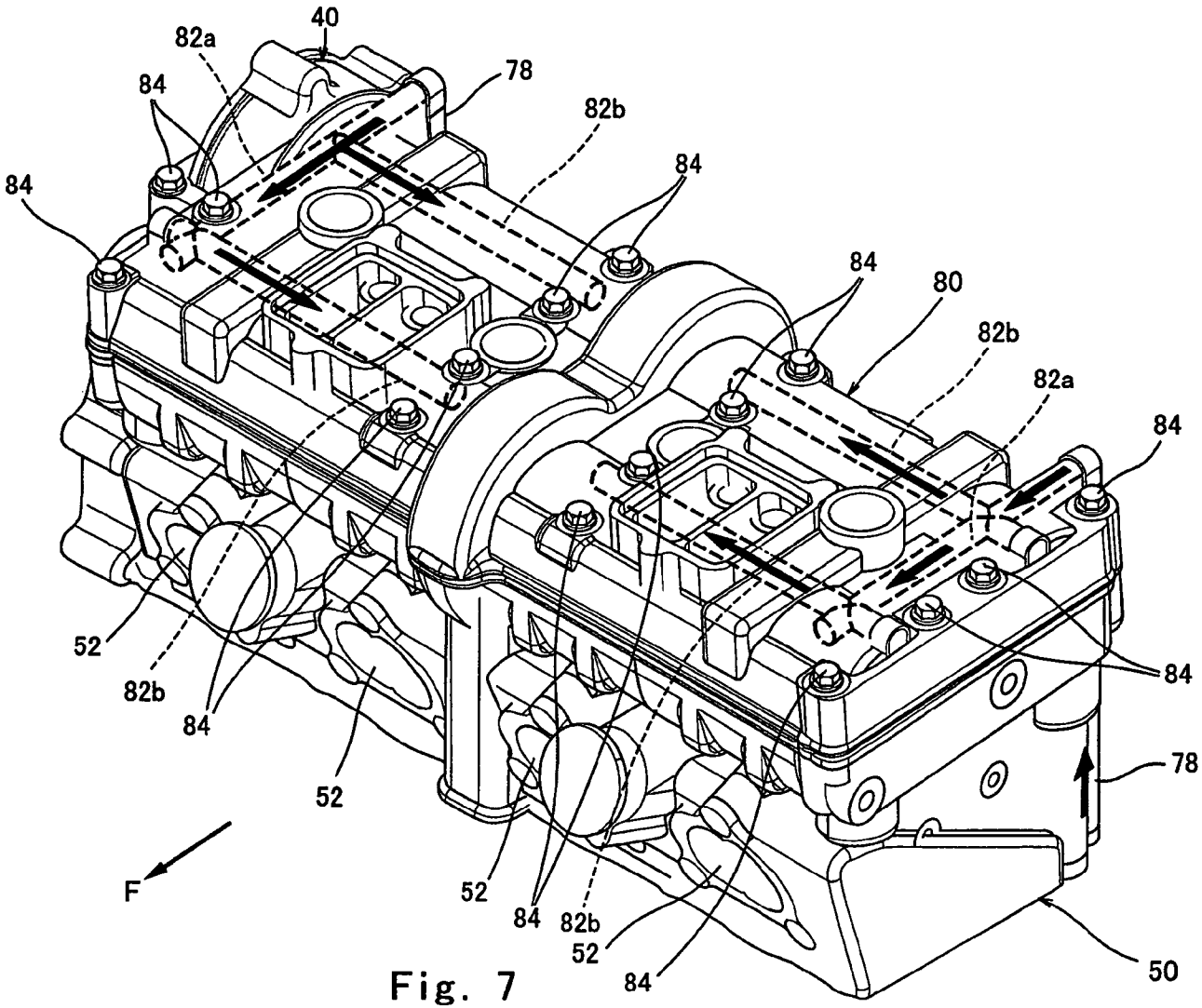
FIG. 7 is a perspective view showing a state where the cylinder head cover of FIG. 6 is attached onto the cylinder head of FIG. 5.
Figure 8:
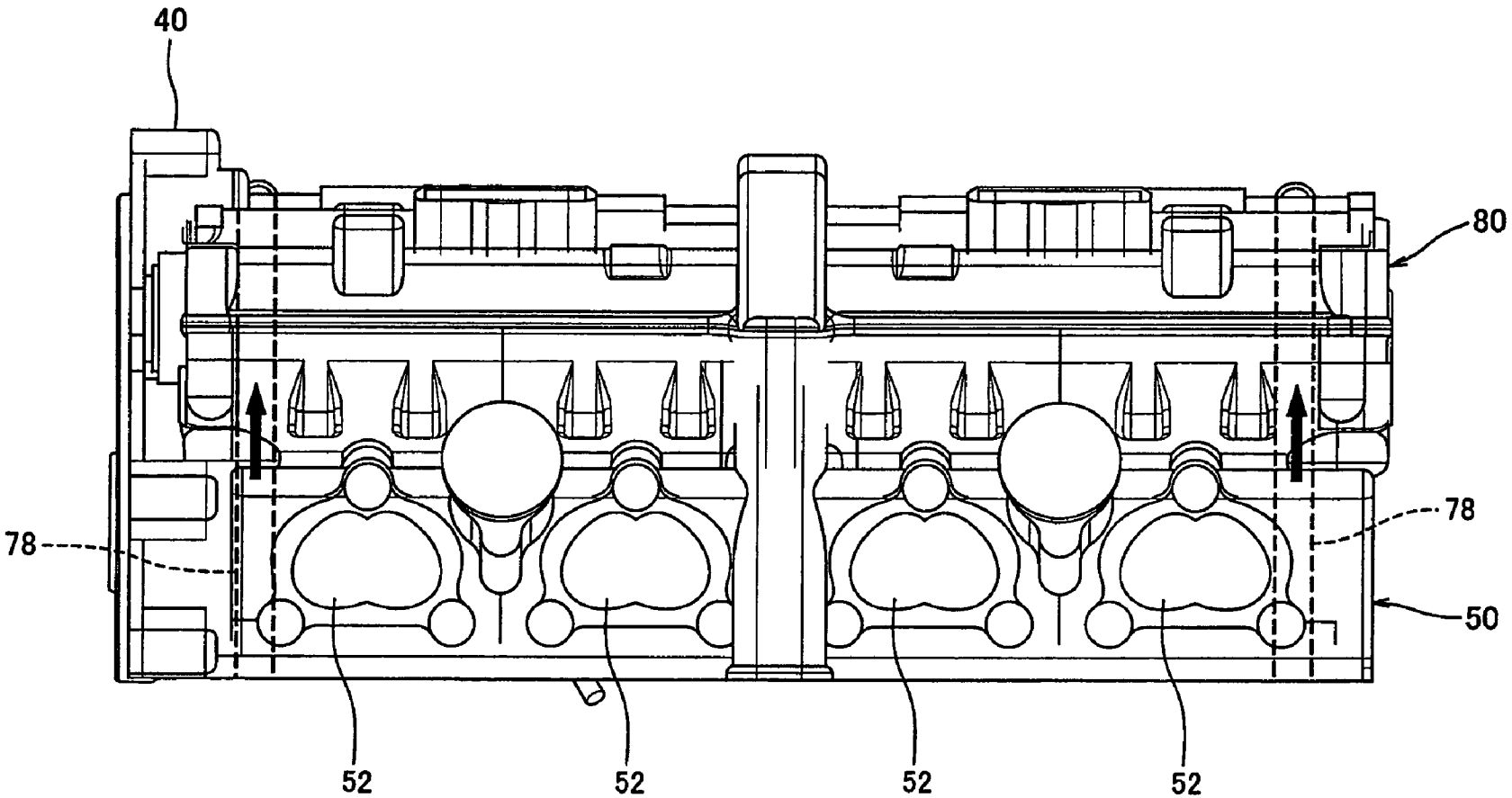
FIG. 8 is a side view of FIG. 7 as viewed from the intake port side.

As shown in FIGS. 5, 7, and 8, an oil feeding system is configured to feed lubricating oil from below, from the cylinder block (not shown), to the camshafts 20 and 20', the cam surfaces, and the intake and exhaust valves (not shown), through two lubricating oil passages 78 formed in the cylinder head 50. In FIGS. 5, 7, and 8, arrows indicate flow directions of the lubricating oil.

Two lubricating oil feeding passages 78 are formed at opposite end portions in the width direction of the cylinder head 50. The lubricating oil flows upward from the cylinder block (not shown) and is fed through the lubricating oil passages 78 into the head cover 80 from opposite sides in the width direction of the cylinder head 50.

Inside the head cover 80, the lubricating oil flows through a lubricating oil passage 82*a* formed inside the head cover 80 in a direction perpendicular to the camshafts 20 and 20', and then flows through two branch passages 82*b* that branch from the lubricating oil passage 82*a*, along the direction in which the two camshafts 20 and 20' extend, and toward the center in the width direction of the head cover 80.

The lubricating oil flowing through the branch passages 82*b* flows downward from the head cover 80 toward each of the camshaft caps 72 and is introduced into the camshaft cap 72 from an introducing port 74 formed on the upper surface of each of the camshaft caps 72. The introducing port 74 is formed in the camshaft cap 72 so as to penetrate vertically. The introducing port 74 serves to feed the lubricating oil to the supporting members of the camshafts 20 and 20', the cams 30, the intake and exhaust valves (not shown) and other components, which are located thereunder. With such a configuration, the lubricating oil can be fed to the camshafts 20 and 20' from opposite sides in the width direction of the cylinder head 50 without interfering with the gears 45 disposed between the cylinders 10.

Figure 9:
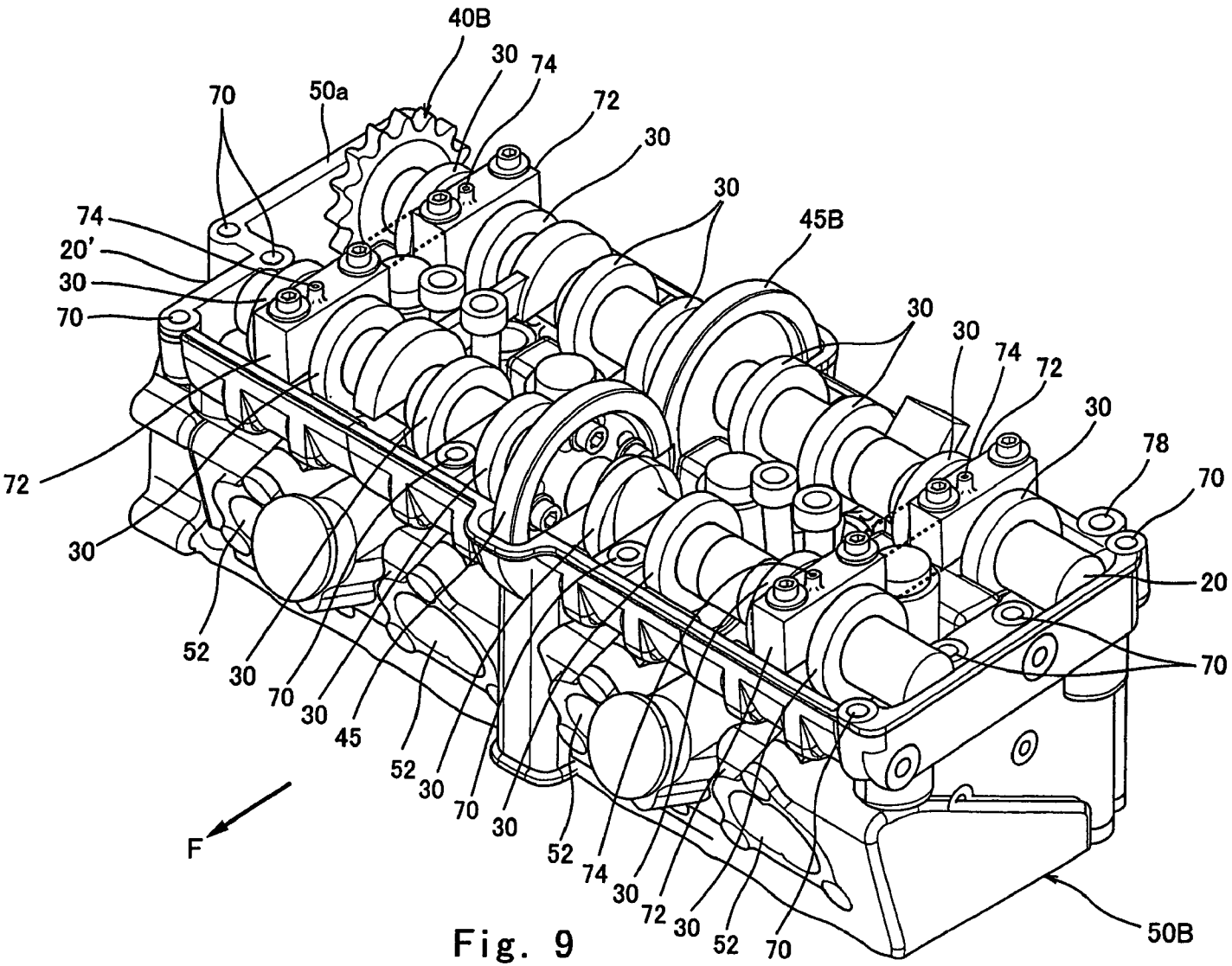
FIG. 9 is a perspective view showing an internal structure of a cylinder head having a structure according to a second embodiment of the present invention.

FIG. 9 is a perspective view showing the structure of a cylinder head 50B including a valve timing adjusting mechanism according to another embodiment. In the cylinder head 50B, the valve timing adjusting mechanism is provided in the gear 45 on the second camshaft 20' side. The valve timing adjusting mechanism is not provided in a gear 45B on the first camshaft 20 side, but instead is provided inside a camshaft drive system 40B including a gear mechanism.

Figure 10:
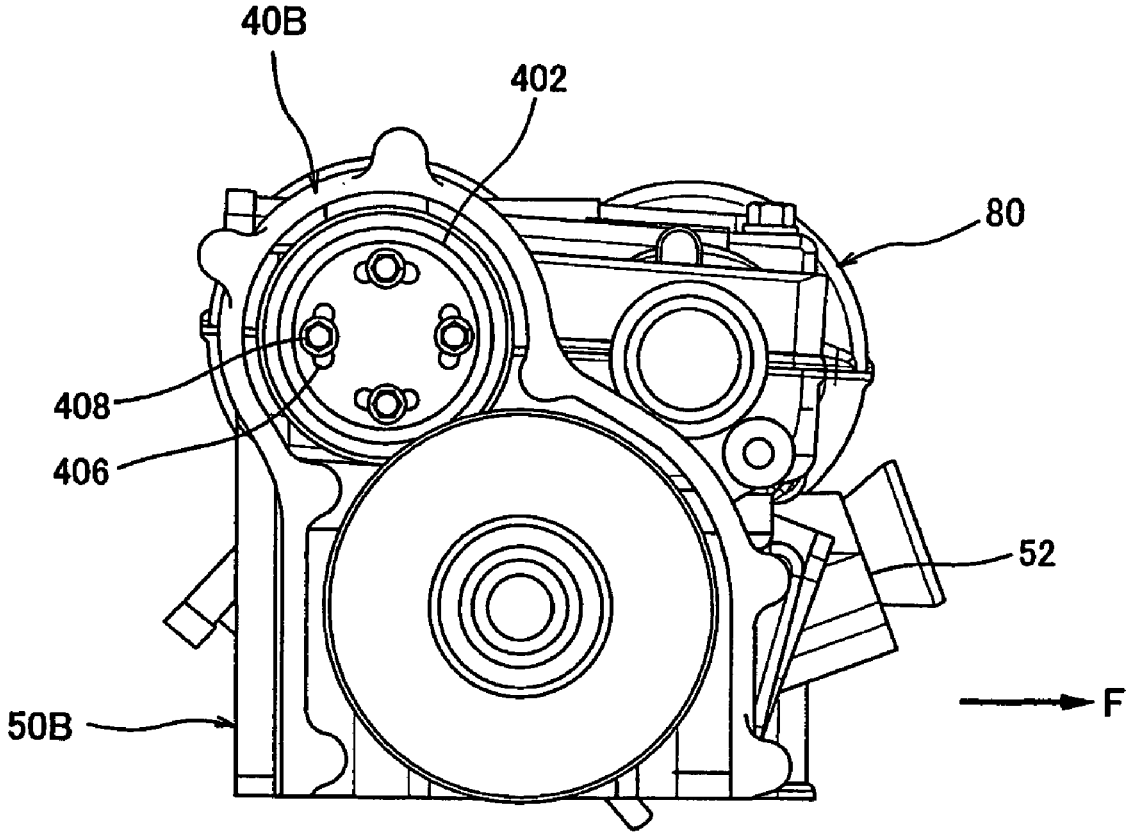
FIG. 10 is a side view of the cylinder head of FIG. 9, as viewed from a camshaft drive system side.

As shown in FIG. 10, the valve timing adjusting mechanism of the camshaft drive system 40B has a structure similar to that of the valve timing adjusting mechanism provided in the gear 45 on the second camshaft 20' side. The valve timing adjusting mechanism is a known mechanism that serves to adjust a rotational phase of a gear 402 with respect to the first camshaft 20 by adjusting a position of a bolt 408 within an elongated hole 406 formed in the gear 402 mounted on the first camshaft 20 so as to extend in a circumferential direction of the gear 402.

The illustrated valve timing adjusting mechanism is hand-operated. As a matter of course, other suitable automatic valve timing adjusting mechanisms may be provided in the cylinder head 50.

In further embodiments shown in FIGS. 9 and 10, the same reference numerals as those in the embodiments described previously denote the same or corresponding parts, which will not be further described.

As described above, the present invention is applicable to motorcycles equipped with engines that are required not to increase a frame width thereof.

As this invention may be embodied in several forms without departing from the essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A multiple-cylinder DOHC engine mounted in a motorcycle, comprising:

a cylinder head;

a first camshaft that is mounted on the cylinder head and is configured to drive one of an intake valve and an exhaust valve mounted on the cylinder head;

a second camshaft that is mounted on the cylinder head and is configured to drive the other one of the intake valve and the exhaust valve;

a camshaft drive system that is mounted at an end portion of the first camshaft in an axial direction thereof and is configured to drive the first camshaft; and a driving power transmission mechanism that is disposed at a center portion of the first and second camshafts in the axial direction to transmit a driving power from the first camshaft to the second camshaft, wherein a pair of frame members of the motorcycle extends substantially rearward and has a width therebetween that is smaller in a vicinity of front end portions thereof, and the second camshaft is disposed between the pair of frame members, wherein the engine is mounted in the motorcycle such that the second camshaft is positioned forward relative to the first camshaft.

2. The engine according to claim 1, wherein the cylinder head is fastened to a cylinder block located thereunder by bolts, and some of the bolts are located below the driving power transmission mechanism.

3. The engine according to claim 1, wherein at least one of the driving power transmission mechanism and the camshaft drive system has a valve timing adjusting mechanism.

4. The engine according to claim 1, further comprising:

first lubricating oil passages that are formed at opposite end portions, in a width direction, of the cylinder head and are configured to feed lubricating oil sent from a cylinder block located thereunder to a cylinder head cover provided over the cylinder head, the width direction being a direction along which a plurality of cylinders of the cylinder head are aligned; and second lubricating oil passages that are formed inside the cylinder head cover and are each configured to feed lubricating oil fed from the first lubricating oil passages to bearings of the camshafts.

5. The engine according to claim 1, wherein the end portion of the first camshaft is extended to be longer than an end portion of the second camshaft in a width direction of the cylinder head, the width direction being a direction along which a plurality of cylinders of the cylinder head are aligned; and wherein the cylinder head has a protruding portion for accommodating the end portion of the first camshaft and the camshaft drive system.

6. The engine according to claim 2, wherein the bolts located below the driving power transmission mechanism are at least partially overlapped by the driving power transmission mechanism in a plan view.

7. The engine according to claim 4, wherein the second lubricating oil passages extend along a direction in which the camshafts extend from the opposite end portions toward the center portion in the width direction.

8. The engine according to claim 5, wherein the cylinder head is integrally provided with the protruding portion.

9. A motorcycle comprising a multiple-cylinder DOHC engine and a pair of frame members extending substantially in a forward and backward direction, the engine including:

a cylinder head;

a first camshaft that is mounted on the cylinder head and is configured to drive one of an intake valve and an exhaust valve mounted on the cylinder head;

a second camshaft that is mounted on the cylinder head and is configured to drive the other one of the intake valve and the exhaust valve;

a camshaft drive system that is mounted at an end portion of the first camshaft in an axial direction thereof and is configured to drive the first camshaft; and a driving power transmission mechanism that is disposed at a center portion of the first and second camshafts in the axial direction to transmit a driving power from the first camshaft to the second camshaft, wherein the pair of frame members of the motorcycle extends substantially rearward and has a width therebetween that is smaller in a vicinity of front end portions thereof, and the second camshaft is disposed between the pair of frame members, wherein the engine is mounted in the motorcycle such that the second camshaft is positioned forward relative to the first camshaft.

* * * * *